United States Patent [19]

Dolan

[11] Patent Number: 4,709,424

[45] Date of Patent: Dec. 1, 1987

[54] AUTOMATIC TOILET BOWL CLEANER DEVICE

[76] Inventor: John E. Dolan, 15 New Main St., Haverstraw, N.Y. 10927

[21] Appl. No.: 732,715

[22] Filed: May 10, 1985

[51] Int. Cl.[4] ..... E03D 9/02

[52] U.S. Cl. ..... 4/228; 4/227

[58] Field of Search ..... 4/228, 227, 368

[56] References Cited

U.S. PATENT DOCUMENTS

| | | | |
|---|---|---|---|
| 650,161 | 5/1900 | Williams | 4/228 |
| 1,175,032 | 3/1916 | Williams | 4/228 |
| 1,226,758 | 5/1917 | Dufty | 4/368 |
| 3,444,566 | 5/1969 | Spear | 4/228 |
| 4,171,546 | 10/1979 | Dirksing | 4/228 |
| 4,216,027 | 8/1980 | Wages | 4/228 |
| 4,350,666 | 9/1982 | Klutts | 4/228 |
| 4,407,779 | 10/1983 | Thompson | 4/227 |
| 4,419,771 | 12/1983 | Richards | 4/228 |
| 4,432,102 | 2/1984 | Woodruff et al. | 4/228 |
| 4,436,269 | 3/1984 | Dirksing et al. | 4/228 |
| 4,455,692 | 6/1984 | Hegge et al. | 4/228 |
| 4,530,118 | 7/1985 | Richards | 4/228 |
| 4,555,819 | 12/1985 | Weiss et al. | 4/223 |

FOREIGN PATENT DOCUMENTS

WO84/00990 3/1984 PCT Int'l. Appl. .

*Primary Examiner*—Henry J. Recla
*Assistant Examiner*—Linda J. Sholl

[57] ABSTRACT

A toilet bowl cleaner device for automatically dispensing a cleaning solution, for example, bleach or blue/detergent into the flush water of a toilet tank; the container includes a chamber for holding a cake of the cleaning material. An interrupted siphon is provided within the container, and a simple vent opening in the top of the container; the siphon comprising overlapping, open-ended conduits. Cleaning solution, formed within the chamber on intake of flush water, is siphoned out as the flush water drops below the bottom of the container. Further features relate to the arrangement of a cup-shaped element at the top of the dispenser, the cup-shaped element holding and dispensing a dye operating as a signal to indicate that the usefulness of the dispenser has terminated. Another feature is a support assembly for holding a pair of independently formed containers in a side-by-side relationship, the support assembly enabling adjustability of the position or level of the containers in the tank.

1 Claim, 9 Drawing Figures

AUTOMATIC TOILET BOWL CLEANER DEVICE

BACKGROUND OF THE INVENTION

1. Field of the Invention

This invention relates to toilet bowl cleaning devices and more particularly to a passive device for continuously forming a cleaning solution and supplying a charge or dose amount of that solution to the flush water automatically in response to the rising and falling of the flush water within a toilet tank.

2. Background Information

A variety of passive dosing dispensers have been known in the art. For example, U.S. Pat. Nos. 650,161 to Williams et al and 1,175,032 to E. R. Williams disclose passive dispensers based upon the use of siphon mechanisms. Also, U.S. Pat. No. 4,171,546 to Dirksing discloses a passive dosing dispenser which includes a reservoir containing a cleaning solution. In operation of the Dirksing dispenser, while the water in the toilet tank is receding from about the dispenser, a predetermined dose-volume of toilet tank water is vacuum-transferred into a reservoir through an inlet conduit, and a substantially equal dose-volume of the product solution is dispensed through a discharge standpipe. However, in order to provide an air lock so as to isolate the product and product solution from toilet tank water, tortuous passageways are provided from inlet to outlet. As a consequence, the manufacture of such a dispenser becomes quite expensive.

Accordingly, it is a primary object of the present invention to make a passive dispenser such that it will be small in size and thereby, much less expensive.

Another object is to fabricate a dispenser by injection molding which is inherently less expensive than thermoforming techniques.

Another object is to simplify the internal structure such that the dispenser is much less likely to clog.

A further object is to obtain extremely rapid release or discharge of the cleaning solution into the tank water. Hence, it becomes possible to discharge the cleaning solution further down into the tank because of the rapid discharge.

SUMMARY OF THE INVENTION

In accordance with the primary feature of the present invention, a container is provided for dispensing a cleaning solution into the flush water of the toilet tank, said container having a chamber for holding a cake of bleach or blue/detergent material; means are provided for the intake of flush water at the bottom of the container, said means including the combination of a first and second conduit which are placed in an overlapping relationship. Thus, the first conduit extends from the bottom of the container to a point near the top thereof, whereas the second container depends from the top wall of the container, the two conduits together constituting a broken or interrupted siphon within the chamber. Moreover, a simple vent opening in the top wall of the container is provided as part of the combination. By the aforenoted construction, including the simple vent opening, the construction of the container is so simplified that it may be readily injection molded.

The operation of the above-noted construction involves taking in flush water through the first of the conduits and allowing it to overflow into a chamber formed within the container. Air is pushed out from the vent opening at the top and the container completely fills with water except for air space inside the second conduit which surrounds and overlaps the first conduit. When the tank is flushed and the water level drops to a point below the bottom of the container, pressure within the container becomes unbalanced and air is pulled through the vent opening. Consequently, the cleaning solution is forced out through the first conduit or discharge pipe, with the result that a siphon action is produced and cleaning solution is emptied down to a level corresponding with the lower end of the second conduit.

Another primary feature of the present invention involves a cup-shaped element, which is formed to extend through the top wall of the container down into the cleaning solution chamber, the lower end of the cup-shaped element being closed. As a result, a receptacle is provided for receiving a dye at the top of the container. This dye operates as a signal to indicate that the usefulness of the dispenser has terminated and that the customer should replace the dispenser.

A specific feature, aside from the provision for placing the dye at the bottom of the aforenoted cup-shaped element, involves at least partly filling the cup-shaped element with a filler. Until the filler is eroded away by constant flow of water, there will be no signal. However, when the filler is eroded, the signal material, that is, the dye, will be swept out into the toilet bowl, thus serving as an indicator that replacement is called for.

Yet another feature of the invention resides in a special arrangement of at least two, separately formed, individual containers. Typically, one of these containers has a cake of bleach inside, and the other container has a blue/detergent or similar composition. A support assembly is provided for completely supporting the dual container arrangement. With this type of packaging, only the simplest kind of container is manufactured; that is to say, a straightforward, injection molded, six-sided container having an uncomplicated internal structure, as already described.

The support assembly for the dual container arrangement includes a bracket; and a support member having a hook at one end adapted to fit over a toilet tank rim, the other end of said support member including a hammer adapted to be selectively retained in different locations in the bracket for varying the height of the container in the toilet tank.

Other and further objects, advantages and features of the present invention will be understood by reference to the following specification in conjunction with the annexed drawing, wherein like parts have been given like numbers.

DESCRIPTION OF PREFERRED EMBODIMENT

Figure 1:
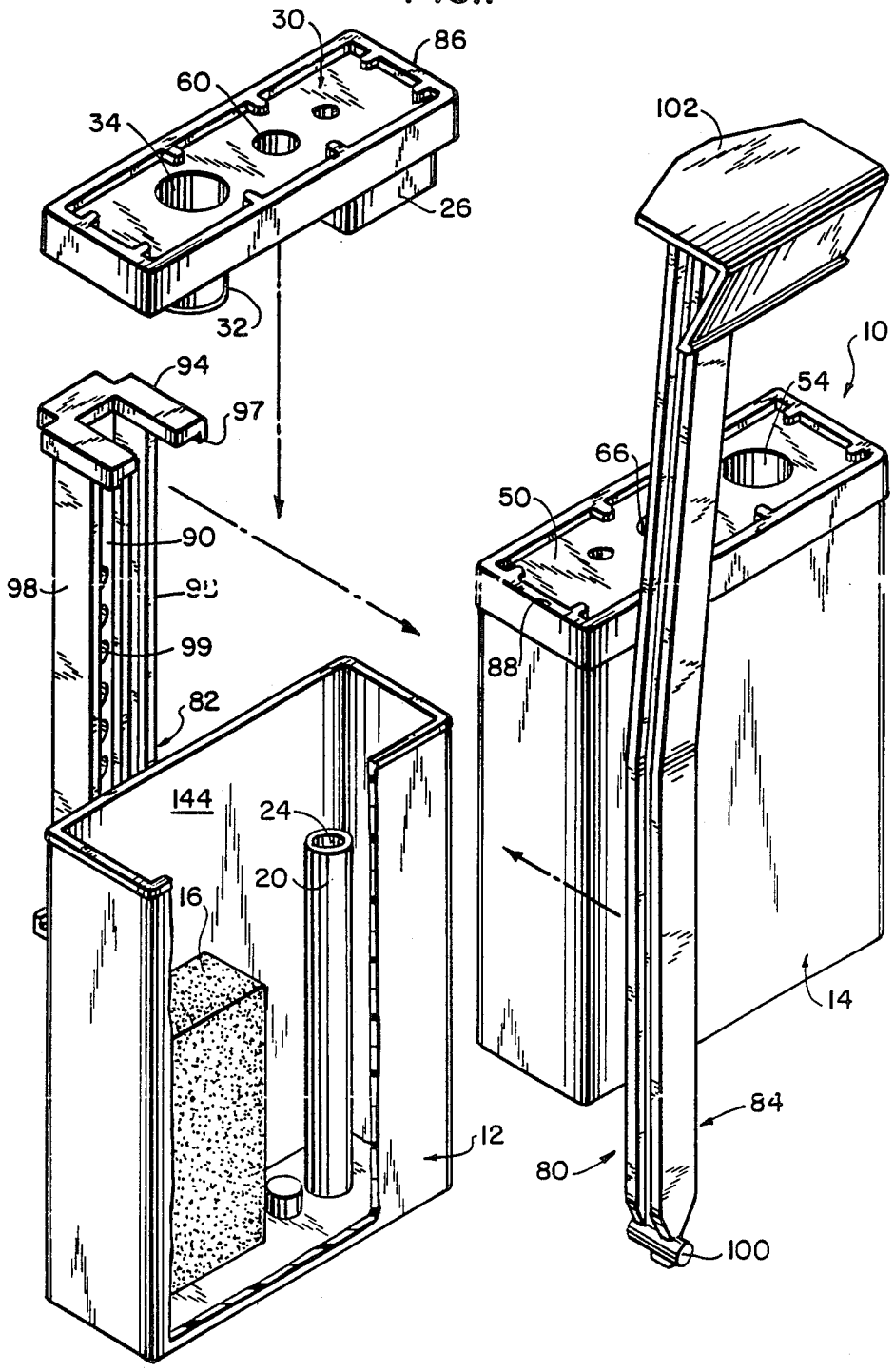
FIG. 1 is an exploded view of the preferred embodiment of a toilet bowl dispenser in accordance with the present invention.
Figure 2:
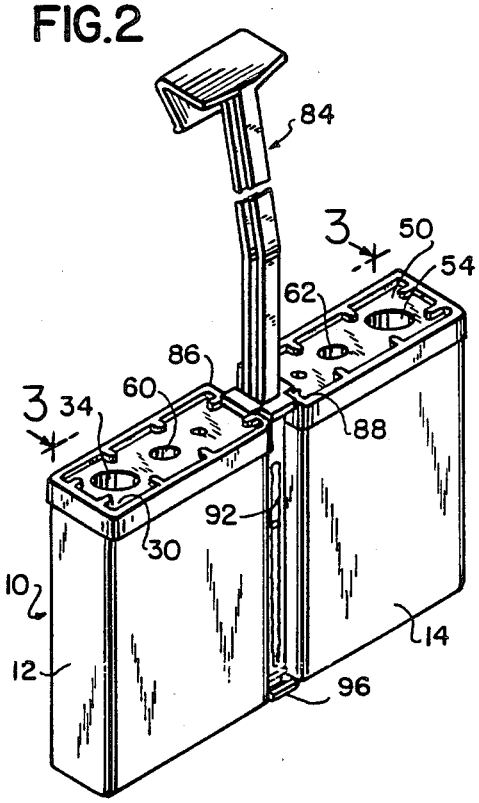
FIG. 2 is a front perspective view of such dispenser.
Figure 3:
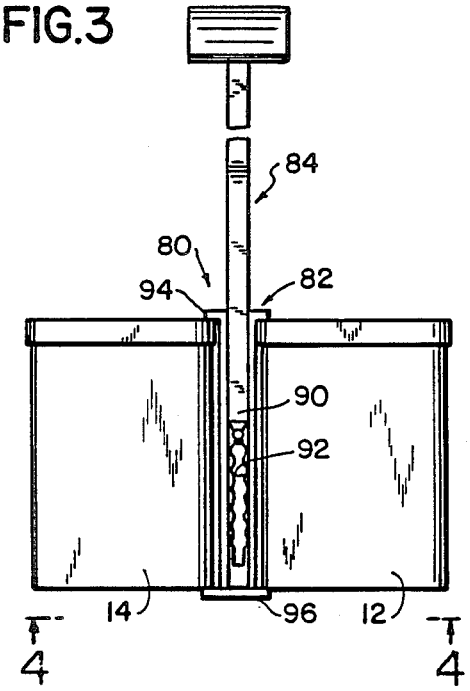
FIG. 3 is a rear elevation view of the dispenser.
Figure 4:
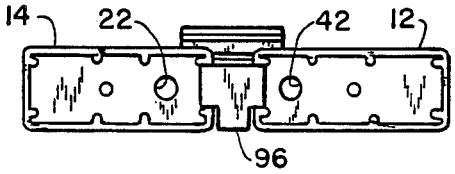
FIG. 4 is a bottom plan view of the dispenser.
Figure 5:
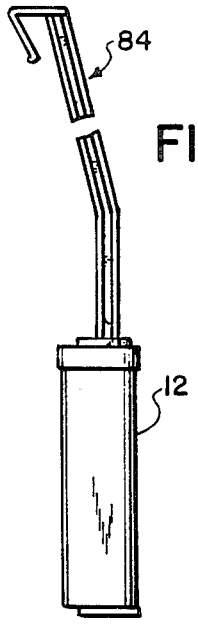
FIG. 5 is a side elevation view of the dispenser.
Figure 6:
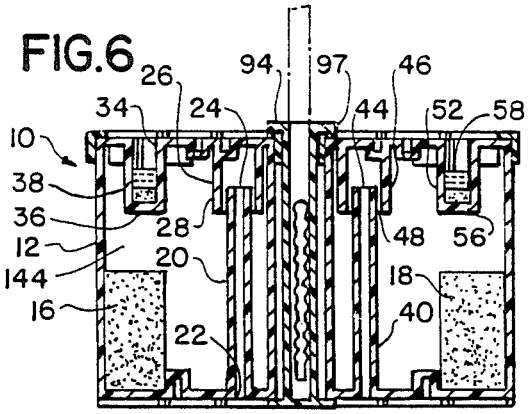
FIG. 6 is a vertical cross-sectional view of the dispenser.

Referring now to the figures of the drawing and particularly for the moment to FIG. 1 and FIG. 6, there is seen in those figures a toilet bowl cleaner device or dispenser 10 comprising a pair of injection molded containers 12 and 14. This dispenser is adapted to be a dual dispenser, that is, to dispense, for example, a bleach in the form of a cake 16 located in the container 12, while a cleaning agent 18, such as a detergent combined with a bluing material, is dispensed from the other container 14.

A first conduit 20 extends from the bottom of the container 12 and terminates in an opening 22 at the bottom of the container. The conduit 20 likewise has an opening 24 at its upper end. A second conduit 26, which may be chosen to be oblong in shape or cylindrical, surrounds the upper end of conduit 20 such that there is a slight overlapping relationship, the end 28 extending below the upper end opening 24 of conduit 20. Conduit 26 is likewise open at its lower end but closed at its upper end, being integrally formed to depend from the top wall 30, which preferably is in the form of a cover member.

A cylindrical cup-like member 32 is formed integrally with the cover member 30 and depends therefrom having an opening 34 at the top of the cover member 30. Dye material 36, chosen to have a striking color, is disposed at the bottom of cup 34. This dye material is washed out at an appropriate time. That is, it is carried into the toilet bowl to serve as a signal to the user that the effective life of the dispenser has ended. Preferably a filler material 38 would be situated above the dye material, such filler material being chosen that it would erode in a time period corresponding with the effective life of the dispenser. A useful filler material would be sodium sulfate in an amount, for example, of 10 grams.

It will be understood that the arrangement within the other container 14 is identical to that already described for container 12. That is to say, the same overlapping conduit arrangement of conduits 40 and 46 with their respective openings 44 and 48 is provided, as well as a cup-shaped member 52 containing dye 56 and filler 58. Likewise, each of the containers 12 and 14 has a vent opening 60 and 62 respectively. The openings 60 and 62 are countersunk within larger openings 64 and 66, respectively, which extend to the tops of the respective containers.

As has been pointed out before, a unique feature of the present invention resides in the support arrangement for the individual injection molded containers 12 and 14. These containers are simply and efficiently snap-fitted into a support assembly designated 80. The support assembly comprises a bracket 82 and a support member 84.

The bracket 82 is so constructed that the aforesaid snap-fitting of the containers may be readily achieved. Thus, the cover members 30 and 50 of the containers include a raised peripheral edge portion 86 and 88 respectively. The containers, as will be seen, thus may be engaged with opposite sides of the bracket 82, identical peripheral edge portions being provided at the bottoms of the individual containers. The bracket 82 is in the form of a U-shaped channel 90 having an extended opening 92 in its web portion. Horizontal members 94 and 96 at opposite ends of the bracket include flange portions 97, appropriately spaced from respective side members 98, for enabling the pressing of the containers into the bracket for firm retention thereof.

A scalloped configuration for the opening 92 results in defining spaced notches 99 for selective retention of the support member 84. This member 84 has a hammerlike portion 100 at its lower end and a hook 102 at its upper end, such hook being adapted to be placed over the rim of a toilet tank. The hammerlike portion 100 is retained within the individual notches defined by the scalloped configuration for opening 92.

Figure 7A:
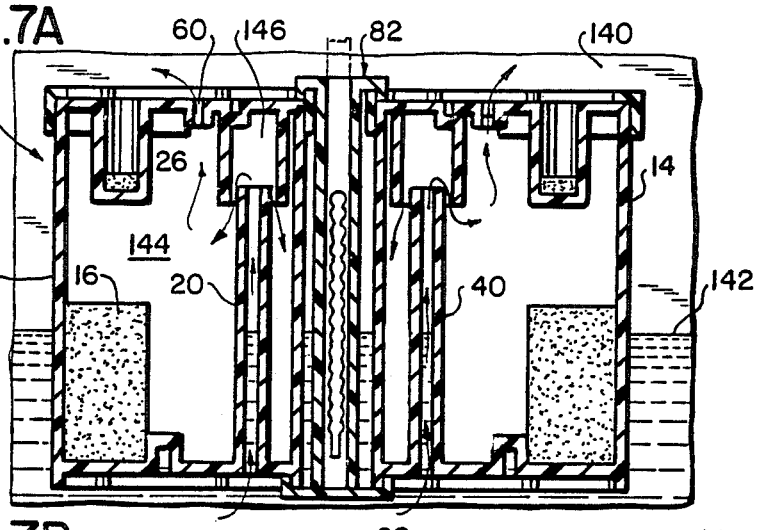
FIGS. 7A, 7B, and 7C are vertical cross-sectional views of the dispenser located, as shown fragmentarily, in the context of a toilet tank; these figures demonstrating the several stages in the operation as the flush water rises and falls.
Figure 7B:
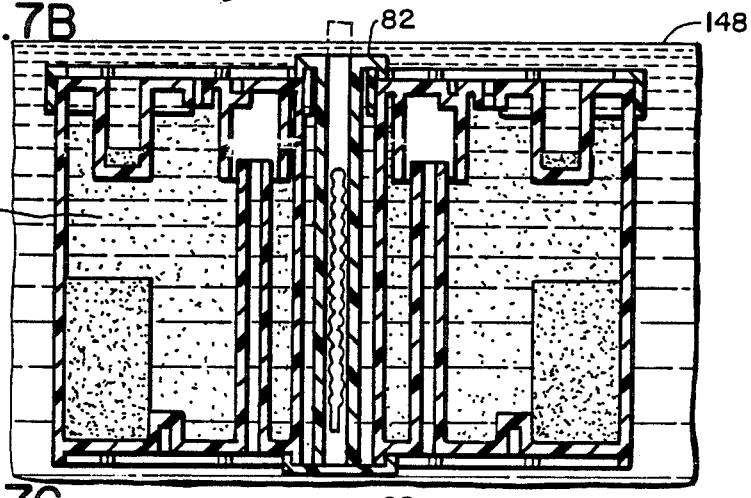
Figure 7C:
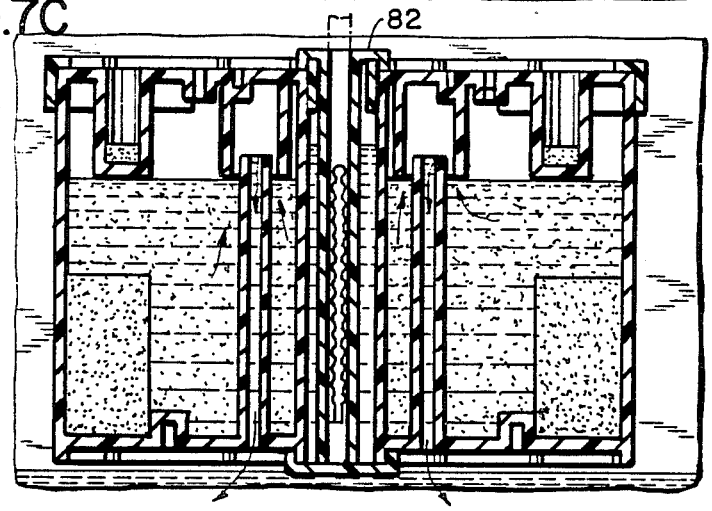

Referring now to FIGS. 7A–7C, the operation of the dispenser of the present invention will now be described. Let it be assumed that water rises in the toilet tank 140 to a level indicated at 142 in FIG. 7A. The flush water will enter the first conduits 20 and 40 in the respective containers. Now, considering only the container 12 since the same operation occurs in container 14, when water thus rises it will push air ahead of it, which will be vented from the vent opening 60, and the water is allowed to flow into chamber 144. A volume of water mixes with the cake of bleach or the like 16., forming a requisite cleaning solution 147. Air becomes trapped in the space 146 but there is not significant counterpressure to restrict the flow of the water at this point. Accordingly, the chamber 144 within the container 12 completely fills with solution (see now FIG. 7B), the water in the tank thereafter reaching a level 148. When the water level rises, as seen at 148, above the top of the container 12, the downward pressure of water trying to enter through 60 equalizes the pressure of the water coming up the conduit 20. The air trapped in the space 146 balances the water in the conduit 20 versus the water trying to enter opening 60. Consequently, the flow of water within the container 12 is halted. Thus the purpose of the "interrupted siphon" defined by the overlapping arrangement of the first conduit 20 and the second conduit 26 has been achieved, that is of trapping air in the space 146. In order to accomplish suitable pressure balance it has been found, as one example, that the conduit 20 should extend 0.1000 inches into the lower end of the conduit 26.

In further operation, let it be assumed that the tank valve has been opened such that the flush water level drops. When the level drops below the bottom of the container 12, as depicted in FIG. 7C, the pressures become unbalanced such that air is pulled through the vent opening 60. Consequently, the cleaning solution mix in the chamber 144 is forced through the conduit 20 with the result that a siphon action commences and the cleaning solution empties until it reaches the level indicated in FIG. 7C.

Accordingly, despite the fact that the siphon is a broken or interrupted one, all of the cleaning solution in the chamber down to the level at the lower end of the conduit 26 is completely discharged. Of course, it will be understood that a similar action takes place in the corresponding chamber of the other container, that is container 14. It will likewise be understood that the whole procedure just described repeats itself with each flush cycle.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

I claim:

1. A toilet bowl dispenser comprising:

a container for dispensing a cleaning solution in flush water of a toilet tank, means for mounting said container in said tank below the water level of said flush water, said container including at least a bottom wall, a horizontal top wall in the form of a cover member having a planar upper surface; and a side wall; further including an opening in the bottom wall of said container, and a chamber for holding a cake of bleach or the like;

means for providing intake and discharge of flush water at the bottom of said container, responsive to the variation in the level of the flush water in said tank, said means including a first, straight conduit extending from said opening in the bottom wall of the container to a point near the top of said container, said first conduit having an outer periphery and terminating in a first opening at said point;

a vent opening through said horizontal top wall;

a second straight conduit depending from the inner surface of said top wall and having an inner periphery larger than the outer periphery of said first conduit, said second conduit being of such length that its bottom end defines an overlap which surrounds the top end of said first conduit, said second conduit terminating in a second planar opening at said bottom end; the two conduits thus defined constituting an interrupted siphon within said chamber;

means for limiting the flow of cleaning solution from said vent opening, said means including the air space at the interior of said second conduit above said first conduit, which air space constitutes an air trap; said means for limiting further including the defined overlap of said second conduit with respect to said first conduit, which overlap extends approximately 0.100 inches;

whereby, when flush water rises in said toilet tank, it initially flows through said first conduit and into said chamber without significant counterpressure to restrict the flow, until said chamber is completely filled and the level of tank water rises above the level of said vent opening such that the downward pressure acts to equalize the pressure of the rising water through said first conduit, air becomes trapped in said interior space, and flow from said container through said vent opening is halted; and, when said flush water drops within said toilet tank, the cleaning solution formed in said chamber is siphoned therefrom until a level is reached at the end of such second conduit.

* * * * *